US010744389B2

(12) United States Patent
Kim et al.

(10) Patent No.: US 10,744,389 B2
(45) Date of Patent: Aug. 18, 2020

(54) SWING ANALYSIS APPARATUS

(71) Applicants: Seong Wan Kim, Daejeon (KR); Deok Kyoo Kim, Daejeon (KR)

(72) Inventors: Seong Wan Kim, Daejeon (KR); Deok Kyoo Kim, Daejeon (KR)

(73) Assignees: Seong Wan Kim, Daejeon (KR); Deok Kyoo Kim, Daejeon (KR)

( * ) Notice: Subject to any disclaimer, the term of this patent is extended or adjusted under 35 U.S.C. 154(b) by 0 days.

(21) Appl. No.: 16/288,756

(22) Filed: Feb. 28, 2019

(65) Prior Publication Data

US 2019/0262690 A1 Aug. 29, 2019

(30) Foreign Application Priority Data

Feb. 28, 2018 (KR) ..... 10-2018-0024270

(51) Int. Cl.

| | |
|---|---|
| ***A63B 69/36*** | (2006.01) |
| ***A63B 71/06*** | (2006.01) |
| ***A63B 24/00*** | (2006.01) |
| *A63B 102/32* | (2015.01) |

(52) U.S. Cl.

CPC ..... *A63B 69/3632* (2013.01); *A63B 24/0006* (2013.01); *A63B 71/0622* (2013.01); *A63B 2024/0012* (2013.01); *A63B 2071/0658* (2013.01); *A63B 2102/32* (2015.10); *A63B 2220/30* (2013.01); *A63B 2220/40* (2013.01); *A63B 2220/833* (2013.01); *A63B 2225/50* (2013.01)

(58) Field of Classification Search

USPC ..... 473/212–215, 219, 222, 223, 226, 231, 473/257, 266–277

See application file for complete search history.

(56) References Cited

U.S. PATENT DOCUMENTS

2012/0289354 A1* 11/2012 Cottam ..... A63B 69/3658 473/223
2013/0102419 A1* 4/2013 Jeffery ..... G09B 19/0038 473/409
2013/0191063 A1* 7/2013 Nomura ..... G01D 18/00 702/89
2014/0295982 A1* 10/2014 Shibuya ..... G09B 19/003 473/212
2015/0328523 A1* 11/2015 Heling ..... A63B 69/3608 473/213

FOREIGN PATENT DOCUMENTS

KR 10-0982482 B1 9/2010

* cited by examiner

*Primary Examiner* — Nini F Legesse
(74) *Attorney, Agent, or Firm* — Novick, Kim & Lee, PLLC; Jae Youn Kim

(57) ABSTRACT

A swing analysis apparatus includes a body installed on a shaft, a sensor unit installed in the body, a display device positioned on the body and configured to display swing information in a swing zone and an impact zone by supplying power thereto, and a controller configured to receive measured swing information from the sensor unit, and configured to operate the display unit to notify the outside of that the swing zone is achieved when the measured swing information is equal to or greater than a setting value and to notify the outside of that the impact zone is achieved, wherein the controller analyzes swing information depending on the swing zone and the impact zone and controls the display device to perform respective different display methods when the swing zone and the impact zone are different.

12 Claims, 6 Drawing Sheets

SWING ANALYSIS APPARATUS

CROSS-REFERENCE IN THE RELATED APPLICATIONS

This application claims the benefit of Korean Patent Application 10-2018-0024270, filed on Feb. 28, 2018, which is hereby incorporated by reference as if fully set forth herein.

BACKGROUND OF THE INVENTION

Field of the Invention

The present invention relates to a swing analysis apparatus, and more particularly, to a swing analysis apparatus for effectively correcting an impact position by accurately measuring swinging information of a user through the swing analysis apparatus including a sensor unit, detecting a position at which an impact occurs based on the measured swing information, analyzing a maximum speed period during a swing, and notifying the user of the analysis result in detail using visual and auditory senses.

Description of the Related Art

In general, as golf has come to be recognized as a form of exercise that greatly helps physical and mental health, golf is drawing a lot of attention as a popular sport and the number of golf enthusiasts has increased exponentially, and, golf is a game in which 3 or 4 rounds of 18 holes are played according to game rules, scores therefrom are totaled, and the golfer with the lowest number of strokes is the winner.

However, as described above, since rounds of golf for many holes are played, victory or defeat tends to be dependent upon concentration and physical condition of golfers, swing accuracy, and the like, and in particular, accuracy when playing golf is highly dependent upon the swing posture of the golfer, and a desired driving distance or accuracy may be achieved only when an effective impact is applied in a correct posture.

That is, when the position to which a golfer applies an impact does not correspond to the position at which a golf ball is hit during a swing, it is not possible to hit the golf ball using maximum power, and thus a driving distance is reduced, and furthermore, accuracy is remarkably lowered.

Accordingly, many golfers go to the effort of taking lessons, watching videos, or taking photographs to correct their swing postures as required in order to acquire as high a score as possible, but it is difficult to accurately recognize the position at which a golfer applies an impact, and thus, a satisfactory result is not achieved compared with the invested time and expense.

These days, golfers go to the trouble of analyzing swing patterns through swing analysis apparatuses using various methods, and are capable of checking swing information such as stroke speed, swing speed, and swing trajectory through an apparatus positioned in an indoor golf simulator.

However, the above swing analysis apparatus using a screen manner requires a wide space and is disadvantageously incapable of analyzing a swing in real time while a golf game is actually played in a golf course, and a user needs to visit a fixed place in order to analyze a swing, which is disadvantageous in terms of time and money.

In addition, there is a problem in that an apparatus for analyzing a golf swing is not capable of being applied to all conventional fields using a swing.

CITED REFERENCE

Patent Document (Patent Document 0001) Korean Patent Publication No. 10-0982482

SUMMARY OF THE INVENTION

Therefore, the present invention has been made in view of the above problems, and it is an object of the present invention to provide a swing analysis apparatus for changing a setting value for each length of a shaft by considering that shafts have different lengths.

The present invention provides a swing analysis apparatus for receiving swing information through the swing analysis apparatus, analyzing a user swing based on the received swing information, and displaying the analysis result on a display unit.

The present invention also provides a simply detachable and portable swing analysis apparatus.

It is to be understood that both the foregoing general description and the following detailed description of the present invention are exemplary and explanatory and are intended to provide further explanation of the invention as claimed.

The swing analysis apparatus for achieving the aforementioned object may have the following configuration.

In accordance with an aspect of the present invention, the above and other objects can be accomplished by the provision of a swing analysis apparatus including a body installed on a shaft, a sensor unit installed in the body, a display device positioned on the body and configured to display swing information in a swing zone and an impact zone by supplying power thereto, and a controller configured to receive measured swing information from the sensor unit, and configured to operate the display unit to notify the outside of that the swing zone is achieved when the measured swing information is equal to or greater than a setting value and to notify the outside of that the impact zone is achieved, wherein the controller analyzes swing information depending on the swing zone and the impact zone and controls the display device to perform respective different display methods when the swing zone and the impact zone are different.

The controller may include a reception module configured to receive the measured swing information from the sensor unit, a comparison module configure to compare the swing information received from the reception module with a setting value pre-stored in the controller a driving module configured to operate the display device when the received swing information is greater than the setting value.

The comparison module may be configured to compensate for the pre-stored setting value depending on the length of the shaft.

The comparison module may be configured to measure an initial angle of the shaft, to configure the length of the shaft, and to compensate for the pre-stored setting value depending on the configured length of the shaft.

The display device may include a display unit positioned outside the body, a light source unit configured to emit light out of the body, and a sound source unit configured to provide notification through a sound source.

The display unit may be configured to display swing information of the shaft.

The light source unit may be configured to be positioned at an upper end portion of the body and is configured to emit light according to a predetermined condition.

The swing analysis apparatus may further include a detachable device positioned on a bottom surface of the body and configured for detachable coupling to the shaft.

The detachable device positioned on the bottom surface of the body may include a slot configured for perpendicular insertion into the shaft, and at least two or more hooks positioned adjacent to opposite ends of the slot to be rotated by 90 degrees and to be fixed to the shaft.

The sensor unit may include at least one of an acceleration sensor, a gyro sensor, a gravity sensor, and an azimuth sensor.

The swing analysis apparatus may further include a communication module of the controller, wherein the communication module may be operatively associated with a smart device using at least one communication method of Bluetooth communication, Bluetooth Low Energy (BLE) communication, near field wireless communication, WLAN (Wi-Fi) communication, ZigBee communication, infrared data association (IrDA) communication, Wi-Fi direct (WFD) communication, ultra-wideband (UWB) communication, Ant+ communication, or a Wi-Fi communication method.

The smart device may be configured to perform swing analysis according to the swing information received from the controller.

The measured swing information may include at least one of a closing angle of a club at address, a closing angle of the club at impact, an angle at which a back swing is converted into a down swing, a down swing trajectory, a swing speed, a ball speed, and a heading direction of a ball.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Hereinafter, exemplary embodiments of the present invention will be described in detail with reference to the accompanying drawings. As those skilled in the art will realize, the described embodiments may be modified in various different ways, all without departing from the spirit or scope of the present invention.

In addition, terms such as 'unit', 'module', etc., should be understood as units that process at least one function or operation and that may be embodied in a hardware manner, a software manner, or a combined hardware and software manner.

The present invention relates to a swing analysis apparatus and provides an analysis apparatus for analyzing a swing of a ball game, golf, hockey, or the like, including a swing, through a shaft 200 of a rigid body. In addition, in the specification, exemplary embodiments of the present invention will be described in terms of golf equipment for explanation of a swing analysis apparatus using the shaft 200 of the rigid body, but are not limited to golf equipment.

Figure 1:
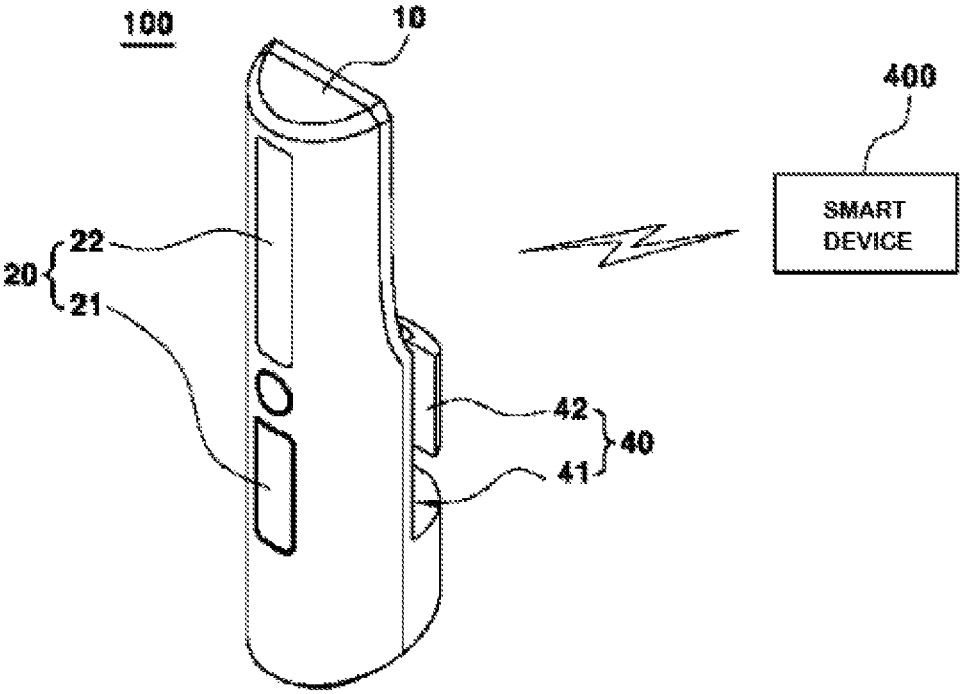
FIG. 1 is a perspective view of a swing analysis apparatus according to an embodiment of the present invention.

FIG. 1 is a perspective view of a swing analysis apparatus according to an embodiment of the present invention.

The swing analysis apparatus may include a body 10 positioned on the shaft 200 formed of graphite or steel, a sensor unit 60 positioned in the body 10, and a display device including a plurality of elements to allow a user to recognize when a predetermined condition is satisfied.

The swing analysis apparatus may include a controller 51 that receives measured swing information from the sensor unit 60, compares the swing information with a configured setting value, and supplies power to the display device 20 when a predetermined condition is satisfied.

Hereinafter, according to an exemplary embodiment of the present invention, the controller 51 may be configured in such a way that a swing speed is stored as a setting value, and a driving module 54 of the controller 51 provides an alarm through the display device 20 when the swing speed of an actual user swing, which is received as swing information, is equal to or greater than the setting value.

In detail, the controller 51 may include a reception module 52 for receiving measured swing information from the sensor unit 60, a comparison module 53 for comparing the received swing information with the setting value prestored in the controller 51, and the driving module 54 for providing an alarm to a user through the display device 20 according to a predetermined condition.

The sensor unit 60 according to the present invention may include at least one of an azimuth sensor configured to determine an opening angle of a club head 300, a gyro sensor for measuring a trajectory of the shaft 200, a gravity sensor for determining a position of the shaft 200, which is changed according to an address posture, or an acceleration sensor and a speed sensor, for measuring swing speed.

The sensor unit 60 may be configured to measure an impact zone and a swing zone and to receive various pieces of swing information such as an opening angle of the club head 300 in the case of address and impact, a heading direction of a ball, a swing trajectory, a trajectory of a back swing and a down swing, and an angle at which a back swing is converted into a down swing.

The received swing information may be received through the reception module 52 of the controller 51 and may be analyzed through the controller 51, and in this regard, the display device 20 may be configured to disclose swing analysis information.

The display device 20 according to the present invention may include a light source unit 22 that provides an alarm to a user through light, a sound source unit (not shown) for providing an alarm to the auditory sense of a user, and a display unit 21 for displaying swing information.

In detail, the light source unit 22 may be configured as at least one or a plurality thereof and may be configured to be positioned in at least a portion of the body 10, and in more detail, may be configured at a position at which the user is capable of recognizing the light source unit 22. In the illustrated embodiment, the light source unit 22 may be positioned at an upper end portion of the body 10, but the position of the light source unit 22 is not limited.

The light source unit 22 may be configured to emit light when a predetermined condition is satisfied by the controller 51, and thus, according to an embodiment of the present invention, may be configured to emit light in a swing zone and an impact zone.

According to an embodiment of the present invention, a length may be configured for each golf club through the sensor unit 60, and the controller 51 may compensate for a preconfigured setting value depending on the configured length of a club. In detail, in the disclosed embodiment, a swing speed may be configured as the setting value, and a swing speed setting value for each club may be compensated for depending on an angle at which the shaft 200 is positioned at address.

That is, the comparison module 53 of the controller 51 may be configured to measure the initial angle of the shaft 200 at address and to configure the length of the shaft 200 depending on the measured initial angle. The comparison module 53 may configure the shaft 200 of a driver to a reference value and may re-configure the length of the shaft 200 depending on the initial angle at address, and thus when a swing is performed using the shaft 200 with a smaller length than the shaft 200 of the driver, the swing speed setting value may be adjusted downwards. Accordingly, the setting value of the swing analysis apparatus may be changed depending on the length of the shaft 200 of a club.

In addition, the length of the shaft 200 may be configured through a manipulation unit positioned in the body 10, and thus, the manipulation unit 30 may be configured to configure an initial setting value and to select a compensation value depending on the length of the shaft 200. The setting value depending on the length of the shaft 200 may be compensated for through a map value that is pre-stored in the controller 51 depending on the length of the shaft 200.

In more detail, the manipulation unit 30 may configure a menu of the display device and may be configured to perform detailed manipulation such as conversion of swing analysis information and menu setting.

Figure 2:
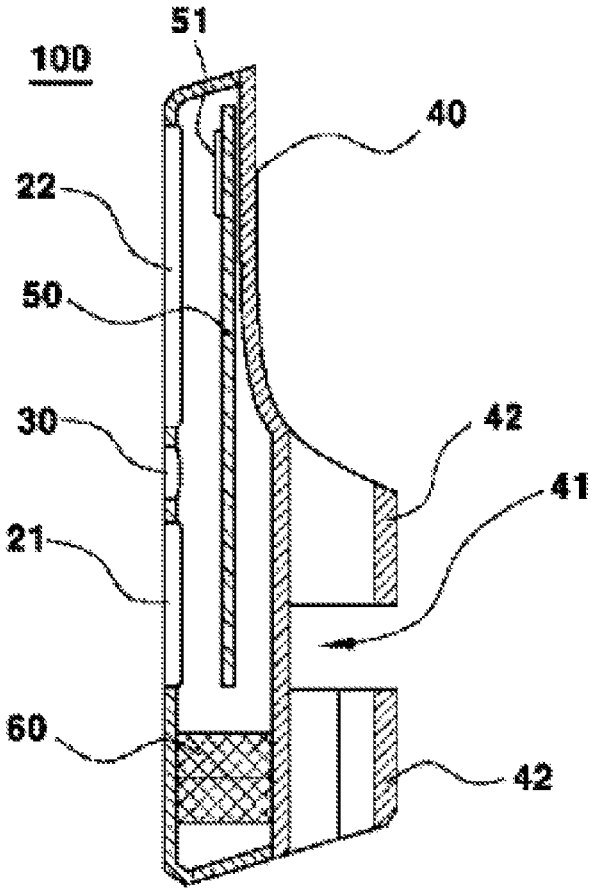
FIG. 2 is a cross-sectional view of a swing analysis apparatus according to an embodiment of the present invention.
Figure 3:
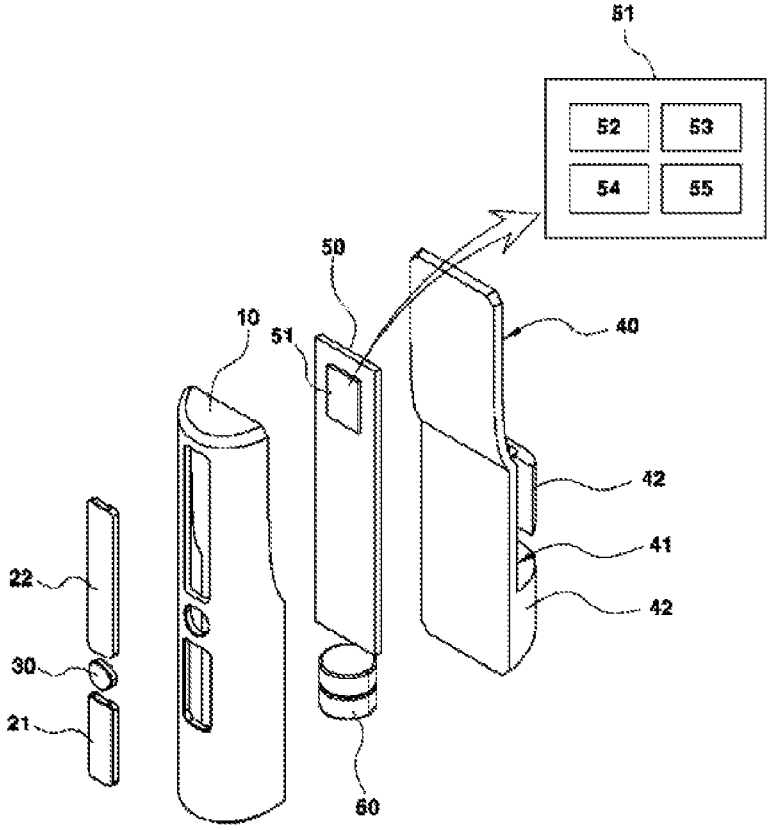
FIG. 3 is an exploded view of a swing analysis apparatus according to an embodiment of the present invention.

FIGS. 2 and 3 are a cross-sectional diagram and a structural diagram of a swing analysis apparatus according to an embodiment of the present invention.

As illustrated in the drawing, the swing analysis apparatus may be configured to include the sensor unit 60, a printed circuit board (PCB), and a power source unit (not shown) inside the body 10 shaped like a housing.

The PCB 50 may be configured to be connected to the display unit 21, the light source unit 22, and a sound source unit, as the display device 20, and may be configured to supply power from the power source unit to the display unit 21, the light source unit 22, and the sound source unit according to a command of the controller 51.

The controller 51 may include a communication module 55, and thus may be configured to be operatively associated with a smart device 400 of a user through the communication module 55. The communication module 55 according to the present invention may communicate with the smart device 400 of the user using Bluetooth communication, Bluetooth Low Energy (BLE) communication, near field wireless communication, WLAN (Wi-Fi) communication, ZigBee communication, infrared data association (IrDA) communication, Wi-Fi direct (WFD) communication, ultra-wideband (UWB) communication, Ant+ communication, or a Wi-Fi communication method, but is not limited thereto.

The smart device 400 that is operatively associated with the controller 51 as described above may be configured to analyze the swing information measured by the controller 51 and to provide a swing performed on the analyzed swing information in the form of an image.

In more detail, the swing analysis apparatus may be configured to analyze a ball-driving distance, an opening angle swing trajectory of the club head 300, and the like based on the swing information measured through the controller 51 positioned in the body 10, and also to analyze the information through the smart device 400.

Accordingly, the swing analysis apparatus may be configured to perform swing analysis through the smart device 400 when an error occurs in the comparison module 53 for performing swing analysis in the controller 51 of the body 10.

In summary, the swing analysis apparatus according to the present invention may be configured in such a way that the reception module 52 of the controller 51 receives separate swing information through the sensor unit 60, the comparison module 53 of the controller 51 compares a preconfigured setting value with measured swing information, and the driving module 54 of the controller 51 provides notification to a user through the display device 20 when a predetermined condition is satisfied.

The swing analysis apparatus may be configured to provide swing information through the communication module 55 configured to be operatively associated with the smart device 400 carried by a user and to provide swing analysis information and an image based on the provided swing information.

According to an embodiment of the present invention, a swing analysis apparatus that configures a swing speed as a setting value may be controlled to configure the swing speed depending on the length of the shaft 200 of a club and to drive the display device 20 depending on a swing zone, in which a swing speed equal to or greater than a configured setting value is measured during an actual swing. In addition, there may also be provided a display method according to a user request in an impact zone with which a ball actually collides.

In addition, when the impact zone and the swing zone are the same, the swing analysis apparatus may be configured to provide notification to a user via a display method different from the display method that is provided when the impact zone and the swing zone are different from each other.

Accordingly, the swing analysis apparatus according to the present invention may provide swing information of the user and may check the difference between the impact zone and the swing zone in real time in order to allow the user to intuitively analyze an actual swing.

Figure 4:
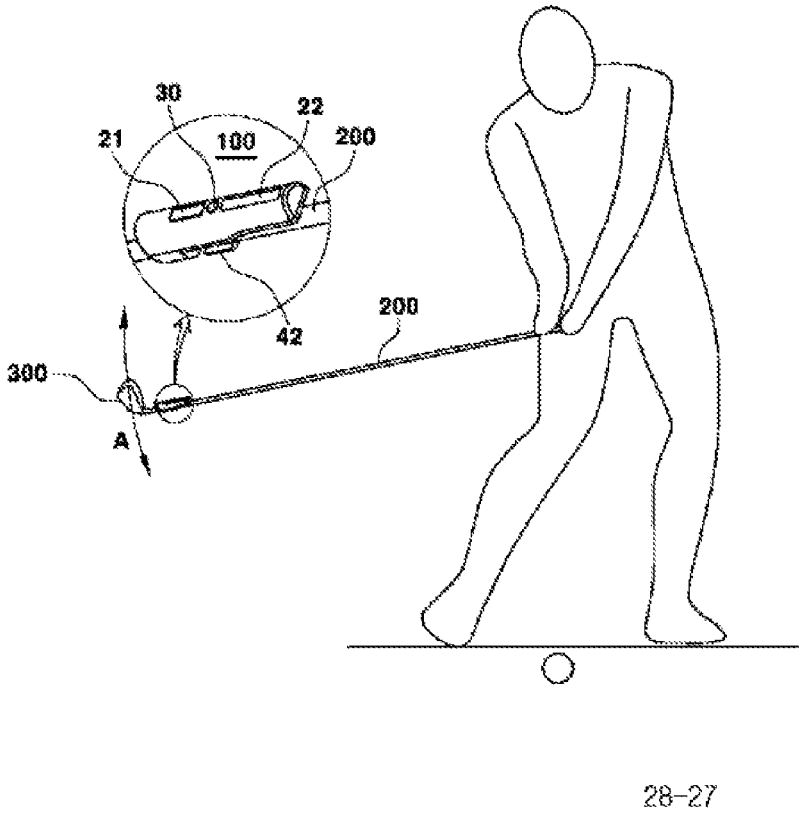
FIG. 4 is a diagram illustrating a swing analysis apparatus that emits light in a swing zone according to an embodiment of the present invention.
Figure 5:
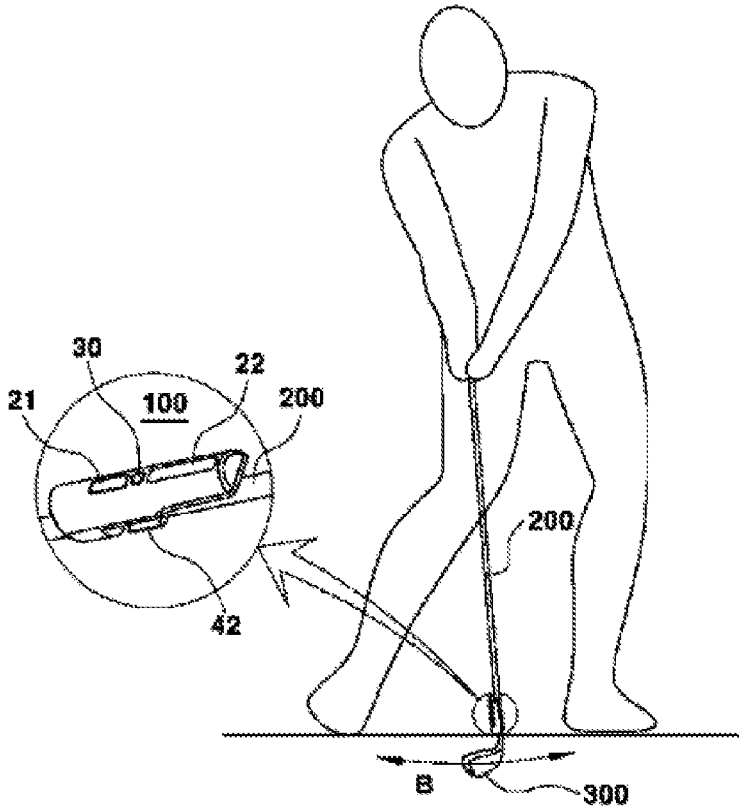
FIG. 5 is a diagram illustrating a swing analysis apparatus that emits light in an impact zone according to an embodiment of the present invention.

FIGS. 4 and 5 disclose a configuration in which the light source unit 22 emits light and the light source unit 22 emits light in a swing zone having a swing speed equal to or greater than a preconfigured setting value according to an embodiment of the present invention.

Swing information of a user may be received based on a setting value that is pre-stored in the controller 51, and when the received swing information is equal to or greater than the setting value, notification may be provided to the user using the display device 20.

In detail, in the case of notification using the display device 20 in the state in which an impact zone and a swing zone are different from each other, notification may be provided to a user using different colors and different sound sources according to a separate zone, and when the impact zone is present in the swing zone, notification may be provided using light or sound in a form different from the case in which the impact zone and the swing zone are different from each other. A method of providing notification may be determined by the user, and an alarm method may be configured through the manipulation unit 30.

According to an embodiment of the present invention, the sensor unit 60 may be configured to include an acceleration sensor and a speed sensor, the light source unit 22 may be configured to emit red, green, and white light depending on conditions set by the user in the controller 51, and various sound sources may be configured to be applied according to separate conditions.

The illustrated configuration corresponds to a swing zone during a golf swing according to an embodiment of the present invention, and an alarm may be provided using the display device 20 in a period with a pre-configured swing speed or greater.

Period A illustrated in FIG. 4 may be a period with a pre-configured swing speed or greater and may be configured to emit red light according to user setting, and period B illustrated in FIG. 5 may be configured to emit white light in an impact zone in which an actual impact occurs.

In more detail, when an impact zone is included in a swing zone, the light source unit 22 may be configured to emit green light, and thus the display device 20 may be operated so as to indicate that a current swing is in an optimum impact zone.

As such, according to the present invention, the swing analysis apparatus may be configured to recognize a swing zone and an impact zone in real time by a user and may be configured to check swing information received via a swing through the display unit 21 in real time to allow the user to more effectively access information based on each swing.

Figure 6:
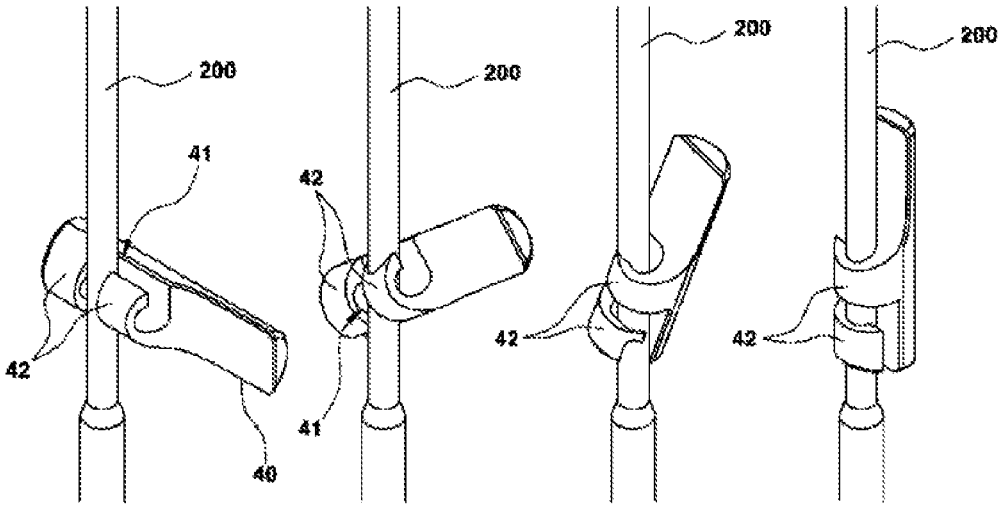
FIG. 6 is a coupling diagram in which a swing analysis apparatus and a shaft are coupled to each other according to an embodiment of the present invention an embodiment of the present invention.

FIG. 6 is a diagram illustrating a method of attaching and detaching a swing analysis apparatus to and from the shaft 200 according to an embodiment of the present invention.

As illustrated in the drawing, the swing analysis apparatus may be configured to include a detachable device 40 on a bottom surface of the body 10 facing the shaft 200, and thus the detachable device 40 may include a slot 41 configured for perpendicular insertion of the body 10 into the shaft 200, and a hook 42 provided in at least two at opposite ends of the slot 41 and configured to fix the body 10 to the shaft 200 to be fitted tightly against the shaft 200.

Accordingly, the detachable device 40 may be coupled to the shaft 200 for perpendicular insertion of the body 10 into the shaft 200, the inserted body 10 may be rotated by 90 degrees to couple the hooks 42 to the shaft 200 so as to be fitted tightly against the shaft 200, and thus may be configured to fix the swing analysis apparatus to the shaft 200 with a high swing speed.

The hooks 42, provided in a number of two or more, may be configured to be positioned at opposite sides based on the slot 41, and each hook 42 positioned at one side based on the slot 41 may include openings that are open in the same direction for fixing to the shaft 200.

In addition, the hooks 42 configured to be symmetrical to each other based on the slot 41 may be configured to have openings at opposite sides based on the slot 41, and thus, the body 10 may be rotated by 90 degrees to insert the shaft 200 into the openings.

The present invention may have the following effects using the embodiments and the aforementioned configuration, coupling, and usage relationships.

The present invention may provide a swing analysis apparatus that is simple to detach from a swing shaft in order to achieve high portability.

The present invention may provide a swing analysis apparatus for receiving swing information of a user depending on the length of a shaft and checking an impact zone and a swing zone based on the received swing information.

Although the embodiments of the present invention have been disclosed for illustrative purposes, those skilled in the art will appreciate that various modifications, additions and substitutions are possible, without departing from the scope and spirit of the invention as disclosed in the accompanying claims.

The embodiments of the present invention have been disclosed for illustrative purposes. The above description has been given with regard to exemplary embodiments of the present invention, and the present invention may be used in various other combinations, modifications, and environments. That is, various modifications, additions and substitutions are possible within the scope of the disclosed concept of the invention and equivalents thereof and/or the technological or knowledge scope of the art to which the invention pertains. The described embodiments are described for the purpose of optimum states for embodying the technological spirit of the present invention, and may be changed in various ways according to necessity in application files and uses of the invention. Accordingly, the above description of the invention is not intended to limit the invention. In addition, the scope of the accompanying claims shall be understood to include other embodiments.

What is claimed is:

1. A swing analysis apparatus comprising:

a body configured to be installed on a shaft;

a sensor unit installed in the body;

a display device positioned on the body and configured to display swing information in a swing zone and an impact zone by supplying power thereto; and a controller configured to receive measured swing information from the sensor unit, and configured to operate the display unit to notify that the swing zone is achieved when the measured swing information is equal to or greater than a setting value and to notify that the impact zone is achieved, wherein the controller analyzes swing information depending on the swing zone and the impact zone and controls the display device to perform respective different display methods when the swing zone and the impact zone are different, wherein the controller includes:

a reception module configured to receive the measured swing information from the sensor unit;

a comparison module configure to compare the swing information received from the reception module with the setting value pre-stored in the controller; and a driving module configured to operate the display device when the received swing information is greater than the setting value.

2. The swing analysis apparatus of claim 1, wherein the comparison module is configured to compensate for the pre-stored setting value depending on a length of the shaft.

3. The swing analysis apparatus of claim 2, wherein the comparison module is configured to measure an initial angle of the shaft, to configure the length of the shaft, and to compensate for the pre-stored setting value depending on the configured length of the shaft.

4. The swing analysis apparatus of claim 1, wherein the display device includes:

a display unit positioned outside the body;

a light source unit configured to emit light out of the body; and a sound source unit configured to provide notification through a sound source.

5. The swing analysis apparatus of claim 4, wherein the display unit is configured to display swing information of the shaft.

6. The swing analysis apparatus of claim 4, wherein the light source unit is configured to be positioned at an upper end portion of the body and is configured to emit light according to a predetermined condition.

7. The swing analysis apparatus of claim 1, further comprising a detachable device positioned on a bottom surface of the body and configured for detachable coupling to the shaft.

8. The swing analysis apparatus of claim 1, wherein the sensor unit includes at least one of an acceleration sensor, a gyro sensor, a gravity sensor, and an azimuth sensor.

9. The swing analysis apparatus of claim 1, further comprising a communication module of the controller, wherein the communication module is operatively associated with a smart device using at least one communication method of Bluetooth communication, Bluetooth Low Energy (BLE) communication, near field wireless communication, WLAN (Wi-Fi) communication, ZigBee communication, infrared data association (IrDA) communication, Wi-Fi direct (WFD) communication, ultra-wideband (UWB) communication, Ant+ communication, or a Wi-Fi communication method.

10. The swing analysis apparatus of claim 9, wherein the smart device is configured to perform swing analysis according to the swing information received from the controller.

11. The swing analysis apparatus of claim 1, wherein the measured swing information includes at least one of a closing angle of a club at address, a closing angle of the club at impact, an angle at which a back swing is converted into a down swing, a down swing trajectory, a swing speed, a ball speed, and a heading direction of a ball.

12. A swing analysis apparatus comprising:

a body configured to be installed on a shaft;

a sensor unit installed in the body;

a display device positioned on the body and configured to display swing information in a swing zone and an impact zone by supplying power thereto;

a controller configured to receive measured swing information from the sensor unit, and configured to operate the display unit to notify that the swing zone is achieved when the measured swing information is equal to or greater than a setting value and to notify that the impact zone is achieved; and a detachable device positioned on a bottom surface of the body and configured for detachable coupling to the shaft, wherein the controller analyzes swing information depending on the swing zone and the impact zone and controls the display device to perform respective different display methods when the swing zone and the impact zone are different, and wherein the detachable device positioned on the bottom surface of the body includes:

a slot configured for perpendicular insertion into the shaft; and at least two or more hooks positioned adjacent to opposite ends of the slot to be rotated by 90 degrees and to be fixed to the shaft.

* * * * *